United States Patent [19]

Lewis

[11] 4,302,320

[45] Nov. 24, 1981

[54] WATER GAS ELECTROLYZER APPARATUS

[76] Inventor: Arlin C. Lewis, Box AU, Libby, Mont. 59923

[21] Appl. No.: 66,364

[22] Filed: Aug. 14, 1979

[51] Int. Cl.[3] ..... C25B 9/00

[52] U.S. Cl. ..... 204/278; 204/272; 204/275; 204/292; 204/294; 204/101

[58] Field of Search ..... 204/128, 129, 101, 292, 204/294, 272, 275, 278

[56] References Cited

U.S. PATENT DOCUMENTS

| | | | |
|---|---|---|---|
| 725,998 | 4/1903 | Sjöstedt et al. | 204/108 |
| 1,032,623 | 7/1912 | Reed | 204/129 X |
| 1,333,837 | 3/1920 | Csanyi | 204/129 |
| 2,070,612 | 2/1937 | Niederreither | 204/129 X |
| 2,384,463 | 9/1945 | Gunn et al. | 204/129 X |
| 2,390,591 | 12/1945 | Janes | 204/129 |
| 3,103,473 | 9/1963 | Juda | 204/292 X |
| 4,092,129 | 5/1978 | Goudal | 204/129 |

*Primary Examiner*—R. L. Andrews
*Attorney, Agent, or Firm*—Sughrue, Mion, Zinn, Macpeak and Seas

[57] ABSTRACT

An electrolyzer device and apparatus for producing water gas at room temperature and pressures that is substantially free from impurities. An electrolyzer cell is described in which a body of carbon-containing material such as pure carbon, graphite, coal or coke is positioned in contact with water which has been rendered conductive by the addition of a solute such as sulphuric acid. A current is passed through the carbon-containing material and water thereby producing water gas as an output product. In one embodiment, the carbon-containing material is pulverized, immersed in conductive water, contacted on one side by a lining of hard carbon material such as graphite and on the other by a porous conductive electrode. In another embodiment, the carbon-containing material is provided as a series of graphite rods of each which are positioned in a conductive water-containing vessel with the rods individually surrounded by copper tubes which are open at the bottom and which have interconnected apertures above the water level in the vessel. The device is self-regulating in that the water level inside the tubes falls as the pressure inside the vessel increases to thereby provide a constant output flow rate of gas.

33 Claims, 3 Drawing Figures

WATER GAS ELECTROLYZER APPARATUS

BACKGROUND OF THE INVENTION

1. Field of the Invention

The invention pertains to apparatus for producing water gas by electrolysis at standard room temperature and pressure. The invention further relates to such apparatus and a method for electrolyzing water and carbon to produce clean water gas which is substantially free from carbon dioxide and oxygen impurities.

2. Description of the Prior Art

"Water gas" is a combustible mixture of gases including primarily hydrogen and carbon monoxide which may be used in a large variety of applications ranging from home heating and powering of automobiles and other vehicles to a wide range of industrial applications. In the prior art, water gas was produced by first igniting coal or coke then blowing air through it until the coal or coke reached a "white hot" temperature, well above 1000° C. The air was then shut off and blasts of steam were blown through the hot coal or coke producing a chemical reaction yielding primarily a mixture of hydrogen and carbon monoxide. Once the coal or coke cools down to around 1000° C., the steam was shut off and air again blown through the coal or coke to bring it back to the desired temperature and the process was then repeated.

There were quite a number of problems involved with this process. The container, called a stove or generator, was very costly because of the lining materials which had to withstand the high temperatures involved in the process. However, most importantly, the water gas so produced contained a number of impurities including carbon dioxide, nitrogen and oxygen which are undesirable from the standpoint of safe and efficient combustion. Oxygen in particular was a particularly undesirable as it rendered the gas per se combustible without the introduction of oxygen from the atmosphere or an external source thereby making the gas generated dangerous to handle and store. Moreover, the process was generally inefficient as the large amounts of heat energy generated by the coal or coke was wasted.

SUMMARY OF THE INVENTION

Accordingly, it is an object of the present invention to provide an apparatus and a method for producing water gas without the problems attendant with the prior art processes.

Specifically, it is an object of the present invention to provide such an apparatus and method for producing water gas which produces such gas without the presence in large amounts of undesirable impurities such as carbon dioxide, nitrogen and particularly oxygen.

Moreover, it is still further an object of the present invention to provide such an apparatus and method which operates at room temperatures and pressures so that special and costly materials which are capable of withstanding both high temperatures and pressures are not required.

It is a still further object of the present invention to provide such an apparatus which is mechanically easy to construct using standard easily available components.

These, as well as other objects of the invention, may be met by the provision of apparatus for producing water gas by electrolysis including a body of carbon-containing material, a volume of water in contact with at least a portion of the surface of the body of carbon-containing material, and means for passing an electrical current through the body of carbon-containing material and the volume of water. Preferably, the volume of water contains a solute for increasing its conductivity. Means is also to be provided for collecting the gas produced by the apparatus. The carbon-containing material may be pure carbon, coal, coke, charcoal or graphite or any mixture of these materials. Means may also be provided for converting the water gas produced by the apparatus to methanol and may include means for pressurizing the water gas to a pressure in excess of about 4000 lbs. per square inch and the provision of a suitable catalyst agent which may be ZnO and $Cr_2O_3$. It may also be desired to attach means for drying the gas produced by the apparatus to the gas outlet. The drying means may include a drying tube having alternate layers of granulated iron and calcium chloride. Still further there may be provided means for removing carbon dioxide from the gas produced by the apparatus which may include means for bubbling the produced gas through a solution of sodium hydroxide.

In one preferred embodiment of the invention, an apparatus for producing water gas by electrolysis from carbon and water includes a conductive containment vessel, a carbon lining disposed upon a lower or bottom portion of an inner surface of the containment vessel, a supply of pulverized carbon-containing material positioned inside the containment vessel and surrounded on all but an upper side by the carbon lining, a supply of water having a conductivity-increasing solute therein, a perforated conductive plate electrode covered by the water and in contact with the upper side of the supply of carbon-containing material, a conductive rod coupled to the conductive plate electrode which extends through an aperture in the containment vessel and is insulated therefrom and means for applying an electrical potential between the containment vessel and conductive rod. An insulating support may be provided for preventing lateral movement of the conductive rod. Also, there may be added a removable access door in a wall of the containment vessel above the level of the carbon lining and the level of the water for recharging the vessel. An outlet pipe may be coupled to the containment vessel at an upper portion thereof above the water level. In order to convert the water gas to methanol, a catalyst adapted for converting water gas components to methanol may be provided in the output line while simultaneously the pressure regulating means in the output line maintains the pressure within the containment vessel at a pressure sufficiently high to effect the conversion of the components to methanol. Preferably, the pressure is maintained above about 4000 pounds per square inch while a catalyst material including a mixture of ZnO and $Cr_2O_3$ is used.

In still another embodiment of the invention, a self-regulating apparatus for producing water gas by electrolysis from carbon and water includes a containment vessel, a water supply within the vessel containing a conductivity-increasing solute and an open space for collecting gas left above the level of the water at a top portion of the containment vessel. One or more rods of carbon-containing material are positioned longitudinally within the vessel with electrical connection being provided to each through the wall of the vessel. A conductive tube surrounds a major portion of each of the rods and extends above the water level within the containment vessel with a water-containing space around each rod reaching to a lower end of each tube well below the water level but above a bottom surface of the containment vessel with interconnected openings being provided above the water level. An outlet pipe is coupled to an upper portion of at least one of the tubes. The containment vessel may be conductive with the tubes each mechanically and electrically coupled thereto. To make electrical connection to the rods, a portion of each of the rods may extend through a corresponding aperture in a bottom portion of the vessel with an insulating seal positioned around each rod in the corresponding aperture with means for making electrical connection to the projecting ends of the rod outside the vessel. An electrical potential is applied between the conductive containment vessel and the rods to activate the electrolysis process. The water gas generated in the apparatus of this embodiment may be converted to methanol by the same means as the embodiment described immediately above.

Still further, objects of the invention can be met by a method for producing water gas including the steps of covering at least a surface of a carbon-containing material in a containment vessel with water containing a conductivity-increasing solute, passing an electrical current through the water and the supply of carbon-containing material, and collecting the gas thereby generated. A catalyst material adapted for converting the generated water gas components to methanol may be provided and the pressure within the containment vessel may be maintained sufficiently high to effect the conversion. A pressure of about 4000 pounds per square inch and a catalyst material including a misture of ZnO and $Cr_2O_3$ are preferred. The collected gas may be dried by passing it through alternate layers of granulated iron and calcium chloride while the gas may be further purified by bubbling it through a solution of sodium hydroxide.

DESCRIPTION OF THE PREFERRED EMBODIMENT

Figure 1:
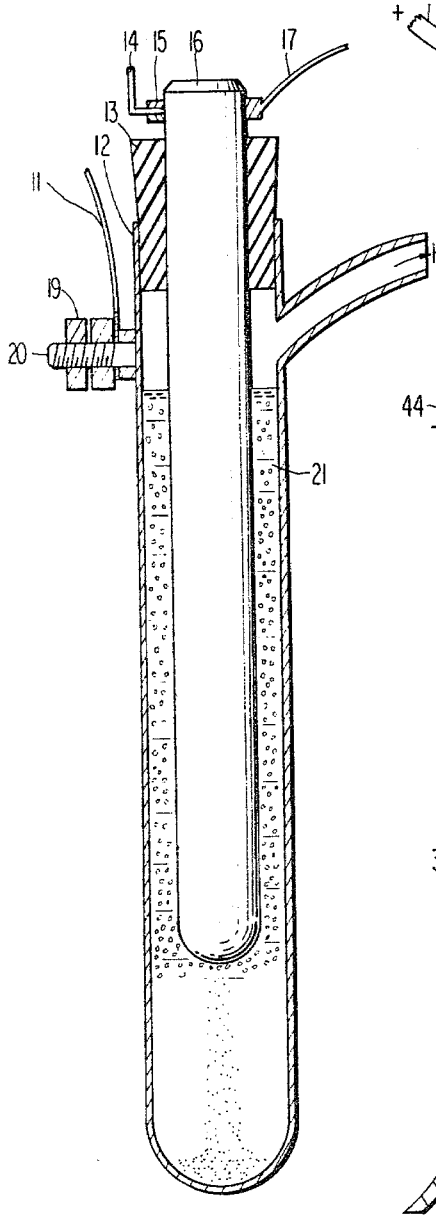
FIG. 1 shows a cross-sectional view of a first embodiment of an apparatus for generating water gas in accordance with the present invention.

Referring first to the cross-sectional view of FIG. 1, there is shown a first embodiment of apparatus for generating high quality water gas at room temperatures and pressures constructed in accordance with the teaching of the present invention. The embodiment shown in FIG. 1 includes a closed bottom conductive tube 12 which may, for example, be made of copper. A carbon or graphite rod 16 is positioned within tube 12 substantially along the center line thereof. Rod 16 is insulated from conductive tube 12 and mechanically supported by a rubber stopper 13 which mates with the opening at the top of tube 12 and has a center aperture adapted to the shape of rod 16.

Electrical connection is made to rod 16 at its upper end through a metal clamp 15. Anode lead 17 is secured to clamp 15 by a tightening handle 14. Cathode lead 11 is an electrical contact with conductive tube 12 and is connected thereto via cathode terminal post 20 to which it is secured by knob 19.

Tube 12 is filled with water approximately to the level shown. Preferably, to the water has been added a small amount of a conductivity-increasing solute such as sulphuric acid, to enhance the rate at which gas is generated. An open space is left above the level of water 11. A gas outlet tube 18 is joined to tube 12 at that point.

Operationally, an electrical potential is applied between anode lead 17 and cathode lead 11 and hence between carbon or graphite rod 16 and conductive tube 12. The anode or positive lead is attached to rod 16 while the negative or cathode lead is attached to conductive tube 12. The applied voltage is DC.

As a result of the application of electrical potential, electrolysis takes place at the surface of rod 16. Hydrogen and oxygen are formed from the water with the hydrogen released into the open space above the water level while the oxygen reacts at the surface of carbon or graphite rod 16 to form carbon monoxide. The mixture of these two gases collects at the open space above the level of water 11 and is extracted through gas outlet tube 18, the mixture of the two gases forming water gas.

Figure 2:
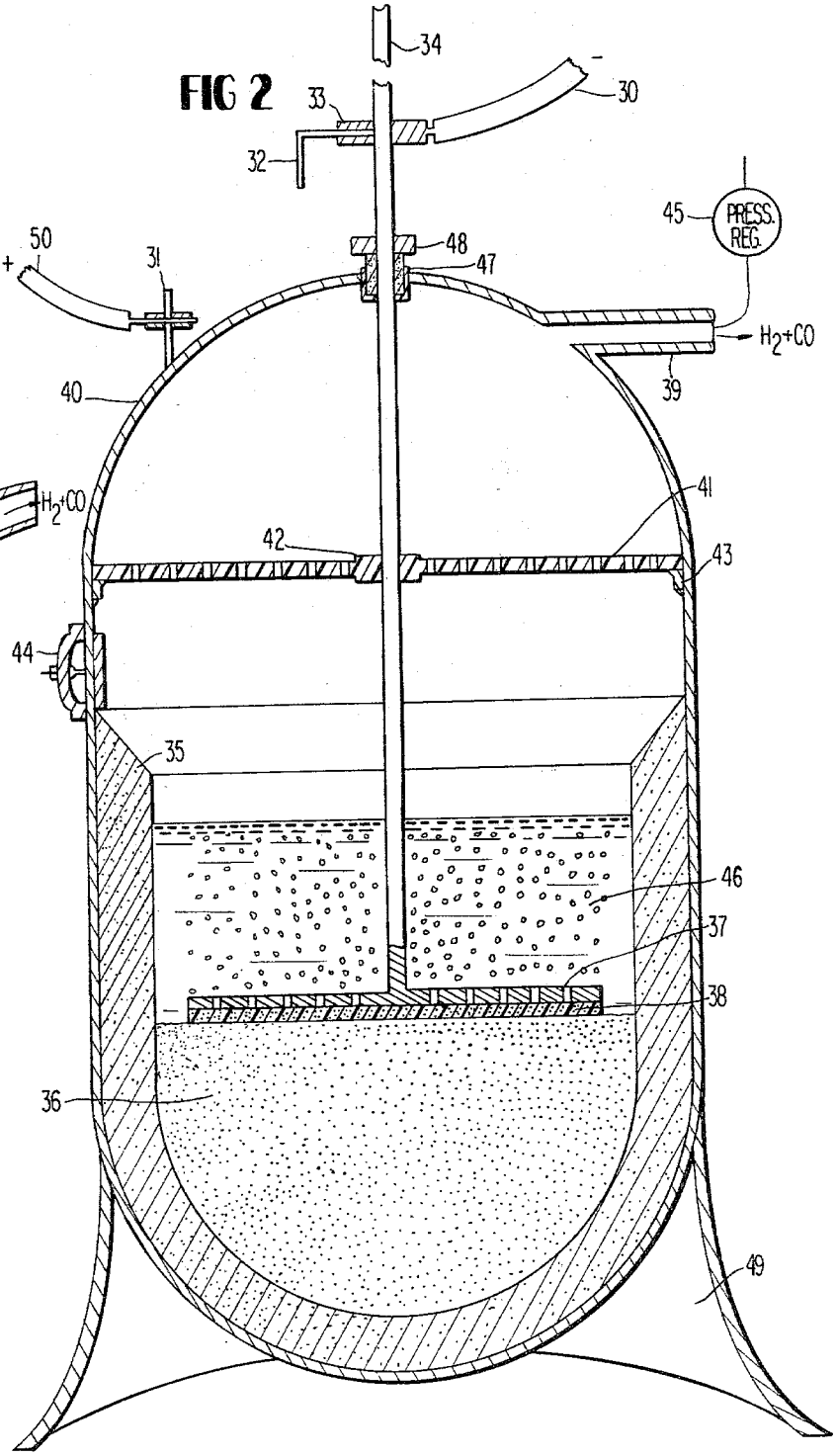
FIG. 2 shows a cross-sectional view of a second embodiment of an apparatus for generating water gas in accordance with the present invention.

A second embodiment of the invention is shown in the cross-sectional view of FIG. 2. A conductive containment vessel 40 has cylindrical center portion with hemispherical ends. The upper of containment vessel 40 is preferably made removable. A graphite or carbon lining 35 is positioned as shown along the inner wall of containment vessel 40 on approximately two-thirds of the inner surface at its lower portion.

A supply 36 of pulverized carbon-containing material is positioned within lining 35. For this material pure carbon, graphite, charcoal, coal or coke may be utilized. However, it is preferred that as pure a carbon material as possible be utilized to eliminate the presence of unwanted impurities in the output gaseous product. The supply 36 of pulverized carbon-containing material is covered by a supply of water 46 to which has been added a conductivity-increasing solute such as sulphuric acid.

Anode lead 50 is attached to conductive containment 40 through a welded connection member 31. Electrical contact is made to supply 36 of carbon-containing material through the walls of vessel 40 and through lining 35. The cathode connection from the cathode or negative lead 30 is made via a copper rod 34 attached at its lower end to a perforated copper plate 37. A layer of porous insulating material 38 is positioned between the lower surface of perforated copper plate 37 and the upper surface of the supply 36 of carbon-containing material. Cathode lead 30 is electrically coupled to copper rod 34 by means of tightening clamp 33 and a handle 32 which adjusts the lead tension.

Copper rod 34 is insulated from conductive containment vessel 40 by an insulating packing nut 48 and insulating seal 47. Lateral movement of the center portion of copper rod 34 is inhibited by insulating perforated support 41 and a bushing 42 which permits copper rod 34 to move up and down as desired depending upon the volume of supply 36. The perforations in support 41 and copper plate 37 are necessary for the gas produced by the electrolysis process to escape from supply 36 and to pass through supply 46 of conductive water to the upper proportion of containment vessel 40 to gas outlet pipe 39. A pressure regulator 45 may be coupled in series through gas outlet pipe 39. Removable door 44 can be used for charging containment vessel 40.

Operationally, a negative potential is applied to copper rod 34 while a relative positive potential is applied to anode lead 50 and conductive containment vessel 40. Upon application of this potential, the electrolysis process commences and water gas is generated in the same manner as with the embodiment described above.

If desired, the water gas generated in the apparatus of FIG. 2 can be converted to methanol. To do this a supply of a suitable catalyst is provided in the outlet pipe circuit and pressure regulator 45 is set to a pressure sufficiently high that the desired reaction for conversion of the water gas components to methanol will occur. For the catalyst, ZnO mixed with $Cr_2O_3$ may be used. For this catalyst, a pressure of greater than about 4000 pounds per square inch may be used. Of course, containment vessel 40 must be sufficiently strong to withstand this pressure.

Figure 3:
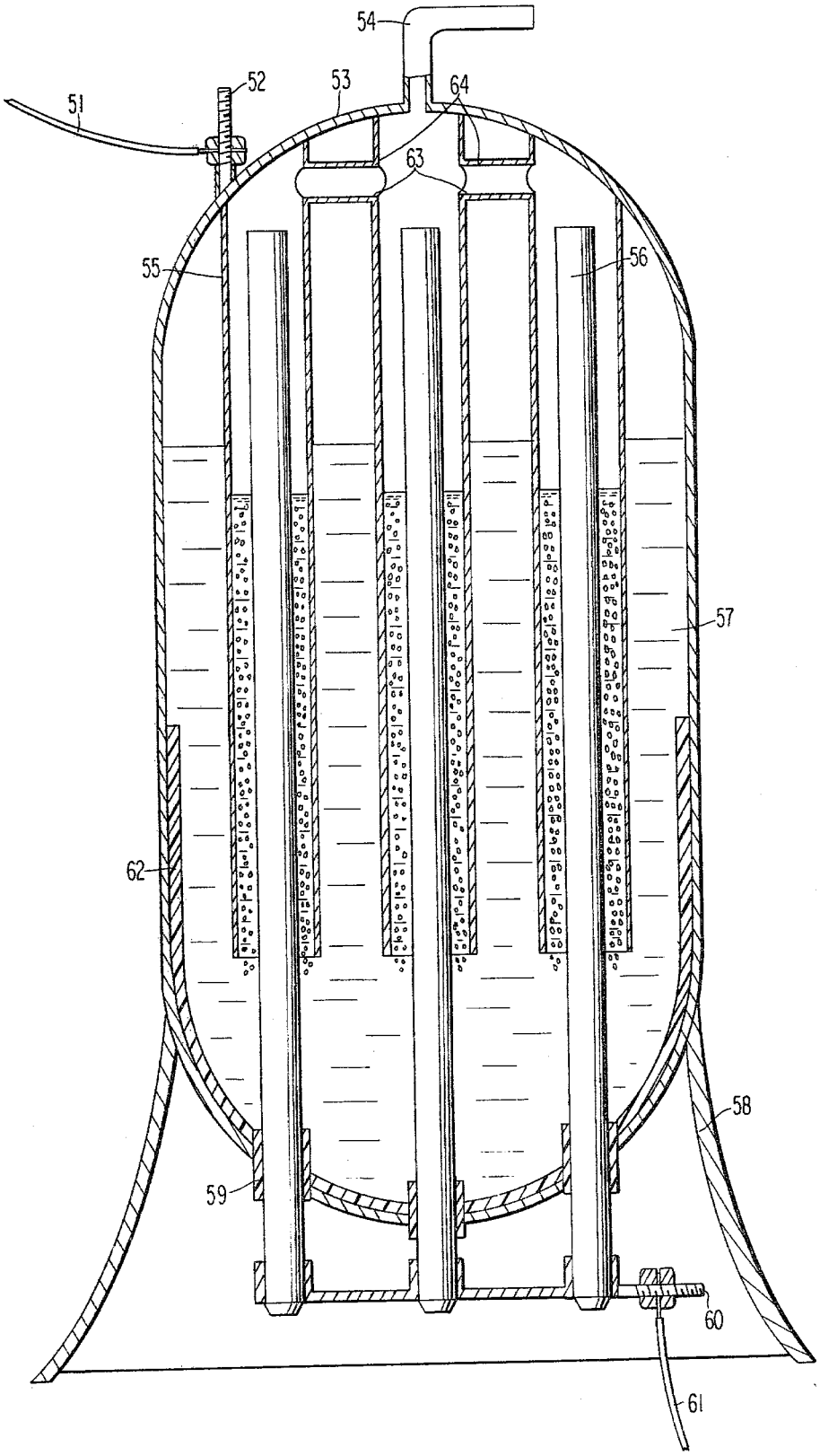
FIG. 3 shows a cross-sectional view of a third embodiment of apparatus for generating water gas in accordance with the present invention.

A third embodiment is shown in the cross-section view of FIG. 3. In this version, a conductive containment vessel 53 is provided much as in the embodiment of FIG. 2. However, different from the embodiment of FIG. 2, the carbon source is provided as, for example, three elongated carbon or graphite rods 56 positioned vertically within containment vessel 53. The lower ends of each of rods 56 extends through a corresponding aperture in the bottom of containment vessel 53. Insulating seals 59 are provided to prevent leakage and to electrically insulate rods 56 from conductive containment vessel 53. The protruding lower ends of rods 56 are electrically coupled by anode connection 60 and hence to anode lead 61.

Each of rods 56 is surrounded for most of its extent by one of copper tubes 55. A water-containing space is formed around each rod 56 between the rod and the corresponding one of copper tubes 55. The lower end of this space is open to conductive water 57 while the upper ends are welded to the upper surface of conductive containment vessel 53. Gas outlet apertures are provided at the upper portions of each of copper tubes 55 with connecting tubes 64 connecting the two side tubes with the center one of copper tubes 55. Otherwise, the interior of the upper portions of copper tubes 55 are sealed from the remainder of the open space above the level of conductive water 57 within conductive containment vessel 53. A gas outlet pipe 54 is connected to one of the upper portions of one of copper tubes 55 whereby gas generated within all three copper tubes 55 can be collected and extracted.

In this embodiment an insulating plastic layer 62 may be positioned along the interior portion of the bottom part of containment vessel 53 simply to collect any debris generated during the electrolysis process to keep from shorting out rods 56 to the surface of conductive containment vessel 53.

Operationally, a voltage potential is applied between rods 56 and copper tubes 55 via annode lead 61 and cathode lead 51, respectively. Once this potential is applied generation of water gas proceeds in the same manner as described for the two embodiments described above.

The embodiment of FIG. 3 has an additional advantage. That is, when the pressure within the upper portions of copper tube 55 exceeds that within the remainder of the space above conductive water 57 within containment vessel 53, the water level in each of copper tubes 55 will drop so that the rate of production of output water gas corresponding decreases. This serves as a self-regulating feature in that when the gas rate of production becomes higher than desired the production rate will automatically decrease.

For the embodiment shown in FIG. 3, additional means may be provided for converting the generating water gas components to methanol by the addition of a pressure regulator and the provision of an appropriate catalyst.

In each of the three embodiments described and in modifications thereto, the gas generated can be further purified by bubbling it through a solution of sodium hydroxide so as to remove any remaining amounts of carbon dioxide that may be present. Also, the gas may be dried by passing it through a drying tube filled with alternate layers of granulated iron and calcium chloride. This latter will also remove any trace amounts of oxygen that may be present.

This completes the description of the preferred embodiments of the invention. Although preferred embodiments have been described, it is believed that numerous modifications and alterations thereto would be apparent to one having ordinary skill in the art without departing from the spirit and scope of the invention. For example, the apparatus of the invention may be constructed in such a way that it can be used and fitted into automotive vehicles with a power supply built in as a combined unit. Otherwise, the power supply can be furnished from regular house current. The apparatus of the invention also may be utilized to supply fuel for homes and industry.

What is claimed is:

1. Apparatus for producing water gas by electrolysis comprising:

a body of carbon containing material;

means for containing a volume of water in contact with at least a portion of the surface of said carbon-containing material; and means for passing an electrical current through said body of carbon-containing material and said volume of water, and wherein said means for containing said volume of water is copper or contains copper.

2. The apparatus of claim 2 wherein said volume of water contains a solute for increasing the conductivity of said water.

3. The apparatus of claim 2 further comprising means for collecting gas produced with said apparatus.

4. The apparatus of claim 3 wherein said carbon-containing material is selected from the group consisting of carbon, coal, coke, charcoal and graphite.

5. The apparatus of claim 3 further comprising means for converting water gas produced by said apparatus to methanol.

6. The apparatus of claim 5 wherein said converting means comprises:

means for pressurizing said water gas to a pressure in excess of about 4000 pounds per square inch; and a catalyst agent.

7. The apparatus of claim 6 wherein said catalyst agent comprises ZnO and $Cr_2O_3$.

8. The apparatus of claim 3 further comprising means for drying said water gas produced by said apparatus.

9. The apparatus of claim 8 wherein said drying means comprises a drying tube comprising alternate layers of granulated iron and calcium chloride.

10. The apparatus of claim 3 further comprising means for removing carbon dioxide from said gas produced by said apparatus.

11. The apparatus of claim 10 wherein said carbon dioxide removing means comprises means for bubbling said gas through a solution of sodium hydroxide.

12. Apparatus for producing water gas by electrolysis from carbon and water comprising:

an electrically conductive containment vessel;

a carbon lining disposed upon lower portions of an inner surface of said containment vessel;

a supply of pulverized carbon-containing material positioned inside said containment vessel and being surrounded on all but an upper side by said carbon lining;

a supply of water containing a conductivity-increasing solute covering said supply of carbon-containing material;

a perforated electrically conductive plate electrode covered by said water and contacting an electrically insulating material separating said conductive plate electrode from said upper side of said supply of carbon-containing material, wherein said conductive plate electrode is copper or contains copper;

an electrically conductive rod coupled to said conductive plate electrode and extending through an aperture in said containment vessel;

means for sealably insulating said conductive rod from said containment vessel; and means for applying an electrical potential between said containment vessel and said conductive rod.

13. The apparatus of claim 12 further comprising an insulating support for preventing lateral movement of said conductive rod.

14. The apparatus of claim 13 further comprising a removable access door in a wall of said containment vessel above the level of said carbon lining and said water.

15. The apparatus of claim 13 further comprising an outlet pipe coupled to said containment vessel at an upper portion thereof.

16. The apparatus of claim 15 further comprising pressure regulating means coupled to said outlet pipe.

17. The apparaus of claim 15 further comprising:

a catalyst material adapted for converting water gas components to methanol; and wherein said pressure regulating means maintains the pressure within said containment vessel at a pressure sufficiently high to effect conversion of said components to methanol.

18. The apparatus of claim 17 wherein said pressure regulating means maintains said pressure above about 4000 pounds per square inch and wherein said catalyst material comprises ZnO and $Cr_2O_3$.

19. The apparatus of claim 12 wherein said carbon-containing material comprises material selected from the group consisting of carbon, coal, coke, charcoal and graphite.

20. Self-regulating apparatus for producing water gas by electrolysis from carbon and water comprising:

a containment vessel;

a supply of water within said vessel containing a conductivity-increasing solute and leaving an open volume at a top portion of said containment vessel;

at least one rod of carbon-containing material positioned within said containment vessel;

means for making electrical connection to each said rod;

an electrically conductive tube surrounding a major portion of each said rod extending above the water level in said containment vessel with a water-containing space around each rod extending to a lower end of each tube above a bottom surface of said containment vessel and having an opening above said water level, wherein said electrically conductive tube is copper or contains copper; and an outlet pipe coupled to said containment vessel at an upper portion thereof.

21. The apparatus of claim 20 wherein said containment vessel is electrically conductive and wherein said tubes are each mechanically and electrically coupled to said containment vessel.

22. The apparatus of claim 21 wherein said means for making electrical connection to each said rod comprises:

a portion of each said rod extending through a corresponding aperture in a bottom portion of said vessel;

an electrically insulating seal positioned around each said rod in said corresponding aperture; and means for making electrical connection to an end of each said rod extending through said aperture.

23. The apparatus of claim 22 further comprising means for applying an electrical potential between said containment vessel and said means for making electrical connection to an end of each said rod.

24. The apparatus of claim 20 further comprising an electrically insulating lining covering at least a portion of a lower portion of an inner surface of said containment vessel.

25. The apparatus of claim 20 further comprising pressure regulating means coupled to said outlet pipe.

26. The apparatus of claim 25 further comprising a catalyst material adapted for converting water gas components to methanol dissolved in said water and wherein said pressure regulating means maintains the pressure within said containment vessel at a pressure sufficiently high to effect conversion of said components to methanol.

27. The apparatus of claim 26 where said pressure regulation means maintains said pressure above about 4000 pounds per square inch and wherein said catalyst material comprises a mixture of ZnO and $Cr_2O_3$.

28. The apparatus of claim 12 wherein said containment vessel comprises copper.

29. The apparatus of claim 20 wherein said containment vessel comprises copper.

30. The apparatus of claim 12, wherein said perforated conductive plate electrode is a copper containing electrode.

31. The apparatus of claim 30, wherein said copper containing electrode is a copper electrode.

32. The apparatus of claim 20, wherein said conductive tube is a copper containing conductive tube.

33. The apparatus of claim 32, wherein said copper containing conductive tube is a copper conductive tube.

* * * * *